US005704882A

United States Patent [19]

Coates et al.

[11] Patent Number: 5,704,882

[45] Date of Patent: Jan. 6, 1998

[54] SIT AND BOUNCE EXERCISE DEVICE

[75] Inventors: Harold E. Coates; Judith I. Coates, both of North Hollywood, Calif.

[73] Assignee: Allison Enterprises, Inc., Oxnard, Calif.

[21] Appl. No.: 691,968

[22] Filed: Aug. 2, 1996

[51] Int. Cl.[6] ..... A63B 22/00; A63B 21/04

[52] U.S. Cl. ..... 482/69; 297/273; 297/274; 482/43; 482/143

[58] Field of Search ..... 482/43, 69, 77, 482/121–123, 143, 23, 24; 297/273, 274, DIG. 11, 281, 282, 280, 452.2, 391; 472/132; 280/47.38

[56] References Cited

U.S. PATENT DOCUMENTS

| | | | |
|---|---|---|---|
| 1,428,039 | 9/1922 | Kratz | 297/273 |
| 2,365,003 | 12/1944 | Reinholz | 297/DIG. 11 |
| 2,697,477 | 12/1954 | Welsh . | |
| 2,723,855 | 11/1955 | McKee | 482/77 |
| 2,860,689 | 11/1958 | Baker . | |
| 3,233,895 | 2/1966 | Grelle | 482/27 |
| 3,369,786 | 2/1968 | Schloemer | 297/410 |
| 3,765,674 | 10/1973 | Siler | 297/273 X |
| 4,199,036 | 4/1980 | Wereb | 180/6.5 |
| 4,948,120 | 8/1990 | Krueger et al. . | |
| 5,399,139 | 3/1995 | Malynowsky | 482/121 |

FOREIGN PATENT DOCUMENTS

| | | | |
|---|---|---|---|
| 131731 | 11/1947 | Australia | 297/281 |

*Primary Examiner*—Richard J. Apley
*Assistant Examiner*—Denise Pothier
*Attorney, Agent, or Firm*—Kelly Bauersfeld Lowry & Kelley, LLP

[57] ABSTRACT

A rebound-type exercise device is provided which allows an individual to perform a sit and bounce exercises. The exercise device includes a support frame which supports a seat assembly by means of four springs. The support frame includes a pair of laterally spaced apart side support frames which are interconnected by a head tube. Each side support frame includes a generally horizontal ground-engaging base tube, a rearwardly disposed, generally vertical strong tube extending upwardly from the base tube, and a generally L-shaped arm which interconnects a front portion of the base tube with the upper end of the strong tube.

10 Claims, 2 Drawing Sheets

20
32
34
36
38
26

66
58

10
12
14
16a
16b
16c
16d
18
24
26
28
30
32
40
42
44
56
58
60
62
64
6
7

24
30

SIT AND BOUNCE EXERCISE DEVICE

BACKGROUND OF THE INVENTION

This invention relates generally to rebound-type exercise equipment. More specifically, the present invention relates to an exercise chair with which one may perform sit and bounce-type exercises.

Regular, daily exercise is necessary for a healthy lifestyle. Regular exercise has many beneficial effects, including stress reduction, stimulation of blood flow, the building of muscle strength, and in some cases the stimulation of the lymphatic system.

Three of the best selling drugs in the United States are used to treat stress-related illnesses. Eighty to ninety percent of all visits to health care professionals are a result of stress-related illnesses and issues, and seventy percent of all accidents are stress related. Constant stress has been linked to many serious diseases and entire centers and clinics for stress reduction and stress management are becoming common in our busy world. Reducing stress can relieve pain in muscles and joints and improve mental stability. Regular exercise is a highly desirable means for managing stress.

The lymph system is literally the body's "tree of life". Lymph fluid is clear and surrounds every cell in the body. Its function is to neutralize, remove or dissolve the toxic wastes that build-up in the body and provide the body's cells with a clean environment in which to perform their life-building tasks. When the lymph system fails to function properly, excess fluid and poisons buildup in the body and pain, loss of energy, infections and disease can take place. The lymph fluid circulates completely through the body approximately two times every 24 hours. The use of rebound-type exercise equipment can speed up the flow of the lymph fluid, increasing the body's ability to eliminate toxins and provide needed nutrients to the body's cells.

Studies have shown that exercises performed with rebound-type equipment increase oxygen supply to the body, stimulate blood flow and improve circulation. Examples of rebound-type exercises include jumping up and down on a diving board or on a trampoline. It is believed that rebound-type exercises advantageously stimulate the lymphatic system because at the top of the jump the body is in an essentially weightless condition. The lymphatic valves open at the top of the bounce, thereby permitting a greater flow of lymph fluids.

Although the advantages of rebound-type exercises are well-known, prior exercise devices are usable only by the most fit of possible beneficiaries. This fact is evident when one realizes that only relatively fit individuals are able to jump up and down on a trampoline or a diving board for a sustained period of time.

Accordingly, there is a need for rebound-type exercise equipment which may be utilized by a far greater number of people than prior devices. Preferably a new piece of rebound-type exercise equipment would permit exercising while one is seated, and yet obtain all of the benefits associated with rebound-type exercise. Further, such an exercise device must be of simple construction, and easy to manufacture of readily available materials. The present invention fulfills these needs and provided other related advantages.

SUMMARY OF THE INVENTION

The present invention resides in a sit and bounce exercise device which advantageously permits an individual to enjoy the benefits of rebound-type exercising without being required to stand. The exercise device comprises, generally, a support frame including a pair of laterally spaced apart side support frames interconnected by a head tube, first spring means supported by the head tube, second spring means disposed forwardly of the first spring means and supported by at least one of the side support frames, and a seat assembly supported within the support frame by the first and second spring means.

In a preferred form of the invention, the head tube comprises an inverted U-shaped tube having ends thereof which are insertable into respective upper ends of the side support frames. Each side support frame comprises a generally horizontal ground-engaging base tube, a rearwardly disposed, generally vertical strong tube extending upwardly from the base tube and having an open upper end, and a generally L-shaped arm which interconnects a front portion of the base tube with the upper end of the strong tube. The ends of the head tube are inserted into the open upper ends of the strong tubes.

Means are provided for securely attaching the head tube to the strong tubes. The attaching means comprises alignable apertures through each of the head and strong tubes, a threaded nut interiorly fixed within each end of the head tube in alignment with its aperture, and a bolt insertable through the aligned apertures of the head and strong tubes.

A padded head piece is attached to a central, generally horizontal portion of the head tube.

A generally U-shaped stabilizer has ends that are insertable into respective open rear ends of the base tubes. Means are provided for securely attaching the stabilizer to the base tubes. The attaching means comprises alignable apertures through each of the stabilizer and the base tubes, a threaded nut interiorly fixed within each base tube in alignment with its aperture, and a bolt insertable through the aligned apertures of the stabilizer and the base tubes.

The first spring means comprises a pair of laterally spaced apart rear springs supported by and hanging downwardly from the head tube. The second spring means comprises a pair of laterally spaced apart front springs supported by and hanging downwardly from the L-shaped arms. Gussets are fixed to the head tube and to the arms, to which the respective springs are attached. A safety sleeve generally envelopes each spring individually.

The seat assembly includes a bottom support, a pair of upwardly extending front straps connected at their upper ends to the front springs, and a pair of upwardly extending rear straps connected at their upper ends to the rear springs. A back support extends between the rear straps, and side straps extend between respective adjacent pairs of the front and rear straps.

Use of the sit and bounce exercise device of the present invention helps to stimulate the flow of lymphatic fluids through the body, thus assisting the body in removing toxins, strengthening the immune system, and building strong, healthy cells. Blood circulation is also improved as well as muscular strength.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
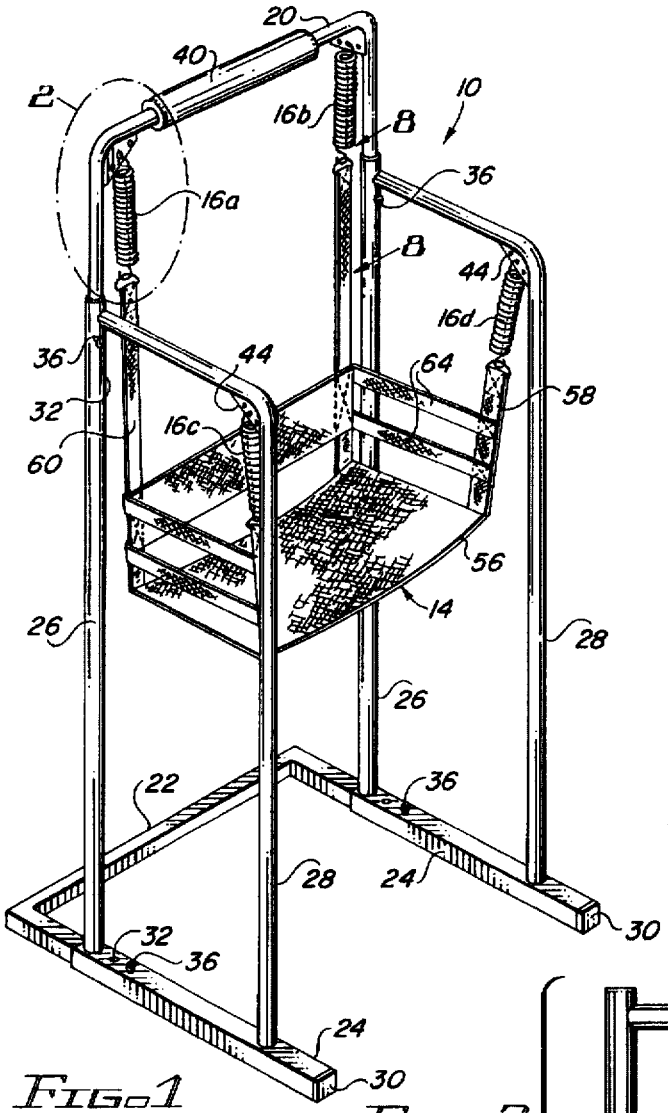
FIG. 1 is a perspective view of a sit and bounce exercise device embodying the invention.
Figure 2:
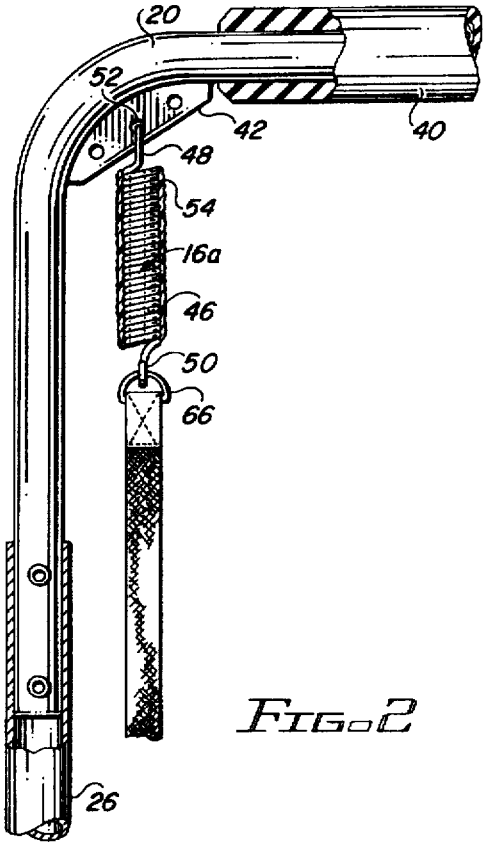
FIG. 2 is an enlarged, fragmented and partially sectional view of the area indicated by the number 2 in FIG. 1, illustrating the attachment of a head tube to a side support frame and details of a spring attached to the head tube which depending therefrom to support a rear strap of a seat assembly.
Figure 3:
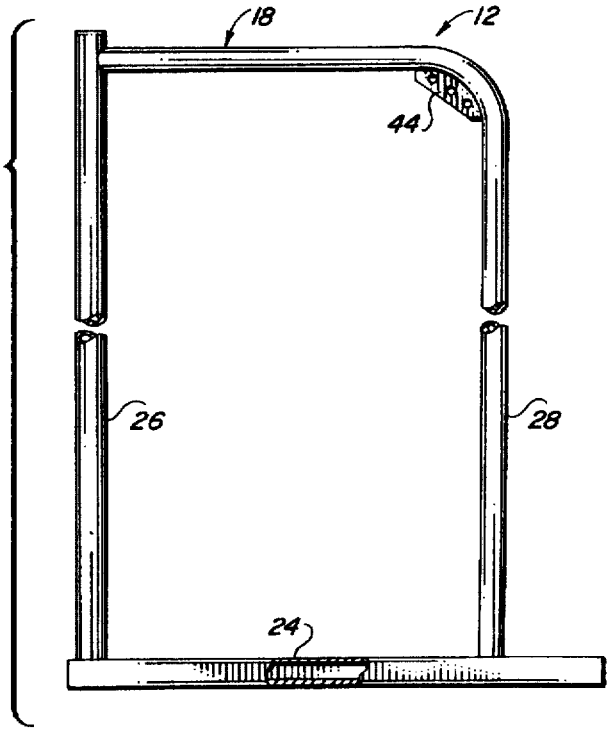
FIG. 3 is a side elevational view of a side support frame shown in FIG. 1.
Figure 4A:
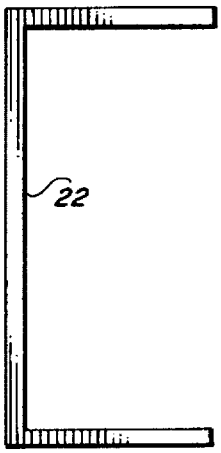
FIG. 4A is top plan view of a stabilizer forming a portion of the support frame.
Figure 4B:
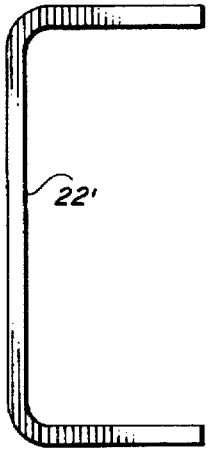
FIG. 4B is top plan view of another configuration for the stabilizer.

As shown in the drawings for purposes of illustration, the present invention is concerned with a sit and bounce exercise device, generally designated in the accompanying drawings by the reference number 10. The exercise device 10 comprises, generally, a support frame 12 and a seat assembly 14 which hangs from a plurality of springs 16*a–d* attached to the support frame.

The support frame 12 is comprised of a pair of laterally spaced apart side support frames 18 which are interconnected at an upper end by means of an inverted U-shaped head tube 20, and at a lower end by means of a U-shaped stabilizer 22. Each side support frame 18 includes a generally horizontal base tube 24 which lies adjacent to a ground surface. Preferably, non-skid feet (not shown) are provided on an under-surface of the base tubes 24. A strong tube 26 extends vertically upwardly from a rear end of the base tube 24. The strong tube 26 has an open upper end configured to receive a corresponding end of the head tube 20 therein. An L-shaped arm 28 extends from a forward end of the base tube 24 vertically upwardly and then rearwardly to the adjacent strong tube 26. The arms 28 interconnect the base tube 24 and the strong tube 26 of the respective side support frames 18.

The front ends of the base tubes 24 are fitted with plugs 30. The free ends of the stabilizer 22 are fitted within the open rear ends of base tubes 24. Thus, the head tube 20 and the stabilizer 22 serve to interconnect the upper and lower ends of the laterally spaced apart side support frames 18.

Figures 5, 6, 7, 8:
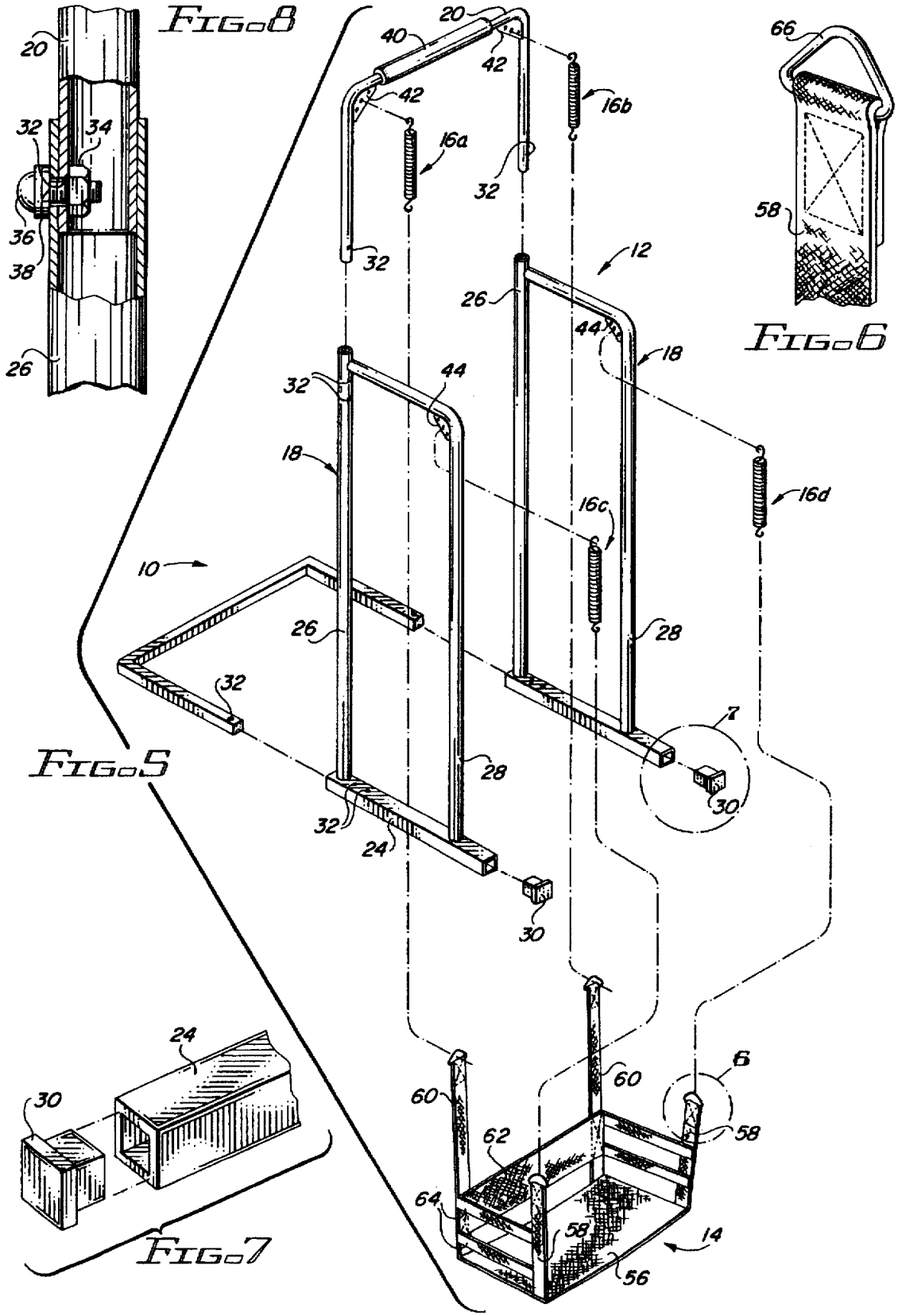
FIG. 5 is an exploded perspective view of the sit and bounce exercise device of FIG. 1.
FIG. 6 is an enlarged fragmented perspective view of the upper end of a front strap of the seat assembly, taken generally of the area indicated by the number 6 in FIG. 5.
FIG. 7 is an enlarged, fragmented perspective view of a front end of a base tube, taken generally of the area indicated by the reference number 7 in FIG. 5.
FIG. 8 is an enlarged, fragmented and partially sectional view taken generally along the line 8—8 of FIG. 1, illustrating attachment of the head tube to the side support frame.

Means are provided for securely attaching the head tube 20 to the strong tubes 26 and the stabilizer 22 to the base tubes 24. In this regard, with reference to FIG. 8, the adjoining tubes are provided alignable apertures 32. The inner tube (either a free end of the stabilizer 22 or the head tube 20) has a threaded nut 34 welded in place on an interior surface adjacent to the aperture 32. Thus, when the apertures 32 are aligned with one another, a bolt 36 carrying a lock washer 38 may be inserted through the aligned apertures 32 to be threadably received by the nut 34.

The upper central portion of the head tube 20 is provided with a padded head piece 40. Secured within the bends of the head tube 20 are gussets 42 which serve to strengthen the head tube 20 and also provide apertures for hanging the springs 16*a* and 16*b* therefrom. Gussets 44 are also provided in the bend section of each arm 28 for a similar purpose.

Four springs 16*a–d* are provided the exercise device 10. A pair of laterally spaced apart rear springs 16*a* and *b* are supported from the head tube 20 gussets 42. A pair of laterally spaced apart front springs 16*c* and *d* are supported by and hang downwardly from the gussets 44 of the side support frames 18. Each spring 16*a–d* includes a central coil spring portion 46, an upper hook 48 and a lower hook 50. The upper hooks 48 are all received within an aperture 52 of the respective gussets 42 and 44. A vinyl safety sleeve 54 generally envelopes each spring 16*a–d*.

The seat assembly 14 includes a bottom support 56, a pair of upwardly extending front straps 58, and a pair of upwardly extending rear straps 60. A back support 62 extends between the rear straps 60, and side straps 64 extends between respective adjacent pairs of the front and rear straps 58 and 60. The upper ends of the front and rear straps 58 and 60 are sewn so as to secure therein a D-ring 66. Each D-ring 66 is placed over a respective lower hook 50 of a respective spring 16*a–d* to position the seat assembly 14 within the support frame 12.

In use, an individual may be seated on the seat assembly 14 and gently bounce vertically while seated to obtain the benefits of rebound-type exercising. The particular configuration of the support frame 12 relative to the seat assembly 14 provides a comfortable exercise environment, and the springs 16*a–d* provide ample support for the total weight of a normal individual seated on the seat assembly. As noted above, benefits of such rebound-type exercising include stress reduction, stimulation of the lymphatic system, stimulation of blood flow and improved circulation, and building strength. The sit and bounce exercise device 10 of the present invention is particularly useful for those individuals who have not been able to exercise on standard equipment. Utilizing the springs 16*a–d* for assistance in pulling up one's body weight, an individual can gently and methodically build muscular strength.

Although a particular embodiment of the invention has been described in detail for purposes of illustration, various modifications may be made without departing from the spirit and scope of the invention. Accordingly, the invention is not to be limited, except as by the appended claims.

We claim:

1. A sit and bounce exercise device, comprising:

a pair of laterally spaced apart side support frames;

an inverted U-shaped head tube having ends thereof insertable into respective upper ends of the side support frames;

a pair of laterally spaced apart rear springs supported by and hanging downwardly from the head tube;

a pair of laterally spaced apart front springs supported by and hanging downwardly from the side support frames; and a seat assembly including a bottom support, a pair of upwardly extending front straps connected at their upper ends to the front springs, and a pair of upwardly extending rear straps connected at their upper ends to the rear springs;

wherein each side support frame comprises a generally horizontal ground-engaging base tube, a rearwardly disposed, generally vertical strong tube extending upwardly from the base tube and having an open upper end, and a generally L-shaped arm which interconnects a front portion of the base tube with the upper end of the strong tube, and wherein the ends of the head tube are inserted into the open upper ends of the strong tubes.

2. The exercise device of claim 1, including means for securely attaching the head tube to the strong tubes, the attaching means comprising alignable apertures through each of the head and strong tubes, a threaded nut interiorly fixed within each end of the head tube in alignment with its aperture, and a bolt insertable through the aligned apertures of the head and strong tubes, the bolt threadably receivable by the respective nut.

3. The exercise device of claim 1, including a generally U-shaped stabilizer having ends thereof insertable into respective open rear ends of the base tubes.

4. The exercise device of claim 3, including means for securely attaching the stabilizer to the base tubes, the attaching means comprising alignable apertures through each of the stabilizer and the base tubes, a threaded nut interiorly fixed within each base tube in alignment with its aperture, and a bolt insertable through the aligned apertures of the stabilizer and the base tubes, the bolt threadably receivable by the respective nut.

5. The exercise device of claim 1, including a padded head piece attached to a central, generally horizontal portion of the head tube.

6. The exercise device of claim 1, including gussets fixed to the head tube and the arm, to which the respective springs are attached.

7. The exercise device of claim 1, including a safety sleeve generally enveloping each spring.

8. The exercise device of claim 1, wherein the seat assembly further includes a back support extending between the rear straps, and side straps extending between respective adjacent pairs of the front and rear straps.

9. A sit and bounce exercise device, comprising:

a support frame including a pair of laterally spaced apart side support frames interconnected by a head tube;

first spring means supported by the head tube;

second spring means disposed forwardly of the first spring means and supported by at least one of the side support frames; and a seat assembly supported within the support frame by the first and second spring means;

wherein each side support frame comprises a generally horizontal ground-engaging base tube, a rearwardly disposed, generally vertical strong tube extending upwardly from the base tube and having an open upper end, and a generally L-shaped arm which interconnects a front portion of the base tube with the upper end of the strong tube, wherein ends of the head tube are inserted into the open upper ends of the strong tubes.

10. The exercise device of claim 9, wherein the first spring means comprises a pair of laterally spaced apart rear springs supported by and hanging downwardly from the head tube, the second spring means comprises a pair of laterally spaced apart front springs supported by and hanging downwardly from the L-shaped arms, the seat assembly includes a bottom support, a pair of upwardly extending front straps connected at their upper ends to the front springs, and a pair of upwardly extending rear straps connected at their upper ends to the rear springs, and a safety sleeve generally enveloping each spring.

* * * * *